US007334560B2

(12) United States Patent
Clark

(10) Patent No.: US 7,334,560 B2
(45) Date of Patent: Feb. 26, 2008

(54) ACCESSORY DRIVE UNIT

(76) Inventor: Tim T. Clark, 4181 NW. 6th St., Deerfield Beach, FL (US) 33442

( * ) Notice: Subject to any disclaimer, the term of this patent is extended or adjusted under 35 U.S.C. 154(b) by 176 days.

(21) Appl. No.: 11/261,423

(22) Filed: Oct. 28, 2005

(65) Prior Publication Data

US 2006/0094557 A1 May 4, 2006

Related U.S. Application Data

(60) Provisional application No. 60/623,781, filed on Oct. 29, 2004.

(51) Int. Cl.
*B63H 20/32* (2006.01)

(52) U.S. Cl. ..... 123/198 R; 123/195 A

(58) Field of Classification Search ..... 123/195 A, 123/198 R

See application file for complete search history.

(56) References Cited

U.S. PATENT DOCUMENTS 3,728,995 A * 4/1973 Schramm ..... 123/195 A
4,368,703 A * 1/1983 Shibata ..... 123/323
4,476,951 A * 10/1984 Ito ..... 180/219
5,460,138 A * 10/1995 Hasegawa ..... 123/179.3
6,336,435 B1 * 1/2002 Yoshikawa et al. ..... 123/195 P
6,346,018 B1 * 2/2002 Watanabe ..... 440/77
2003/0015166 A1 * 1/2003 Seymour ..... 123/198 R

* cited by examiner

*Primary Examiner*—Stephen K. Cronin
*Assistant Examiner*—Jason Benton
(74) *Attorney, Agent, or Firm*—Robert C. Kain, Jr.; Fleit Kain

(57) ABSTRACT

The accessory drive unit, mounted intermediate an engine and a transmission, provides mounts for a water pump, an alternator, a supercharger and a starter. The accessory drive unit includes a main planetary gear driving a supplemental gear which is rotatably interconnected to a bevel gear driving a supercharger shaft. A first pilot gear is rotatably coupled to the main gear and is coaxially mounted to a second pilot gear. A water pump gear is rotatably coupled to the second pilot gear. An alternator gear is rotatably coupled to the first pilot gear. A flywheel is mounted on the engine drive shaft and has a peripheral gear thereon. The starter has a geared drive shaft which is adapted to rotatably interlink with the peripheral gear on the flywheel.

5 Claims, 7 Drawing Sheets

SEC A–E

SEC $A_1$–D

A–C

ACCESSORY DRIVE UNIT

This application is a regular patent application based upon and claiming the benefit of provisional patent application Ser. No. 60/623,781, filed Oct. 29, 2004, now pending The present invention relates to an accessory drive unit for marine, automobile and motorcycle accessories, such as alternator, water pump, supercharger and a starter, mounted to a drive unit installed between the engine and the transmission of such marine vessel, automobile or motorcycle.

BACKGROUND OF THE INVENTION

Engine accessories are typically mounted to transmissions and engines via various belts or chain drives. It is beneficial to have an accessory drive unit that has drive ports adapted to provide motive power to certain engine accessories such as an alternator, water pump, supercharger and a starter. Although it is known to drive a starter off a peripheral gear on a flywheel mounted to an engine shaft (or extension thereof), it is not known how to mount other engine accessories, that is an alternator, water pump, or supercharger, directly onto the engine shaft or extension thereof.

OBJECTS OF THE INVENTION

It is an object of the present invention to provide an accessory drive unit for a marine vessel, an automobile or a motorcycle which accessory drive unit is mounted intermediate the engine (on a fore side) and a transmission (on an aft side).

It is another object of the present invention to provide an accessory drive unit which eliminates belts or chains driving the accessories which are an alternator, water pump, supercharger and a starter.

SUMMARY OF THE INVENTION

The accessory drive unit is mounted intermediate an engine and a transmission in a marine vessel, automobile or motorcycle. The accessory drive unit is adapted to retain and mount a water pump, an alternator, a supercharger and a starter thereon. The accessory drive unit includes a main planetary gear mounted to an engine drive shaft. A first supplemental gear is rotatably interconnected to the main gear. The first supplemental gear is coupled via a bevel gear to a supercharger shaft. The supercharger shaft is adapted to drive the supercharger which is mounted on the outside of the housing of the accessory drive unit.

A first pilot gear is rotatably coupled to the main gear and a second pilot gear is coaxially mounted to the first pilot gear. A water pump gear is rotatably coupled to the second pilot gear. The water pump, mounted to the outside of the accessory drive unit housing, is further coupled to the water pump gear such that the gear drives the water pump. An alternator gear is rotatably coupled to the first pilot gear and is adapted to drive the alternator which is also attached or mounted to the outside of the housing. A flywheel is mounted on or about said engine drive shaft inside the accessory drive unit housing. The fly wheel has a peripheral gear thereon. The accessory drive unit has a mount for the starter. The starter has a geared drive shaft which is adapted to rotatably interlink with the peripheral gear on the flywheel.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF EMBODIMENTS OF THE INVENTION

The present invention relates to an accessory drive unit for marine, automobile and motorcycle accessories, such as alternator, water pump, supercharger and a starter, mounted to a drive unit installed between the engine and the transmission of such marine vessel, automobile or motorcycle.

Figure 1A:
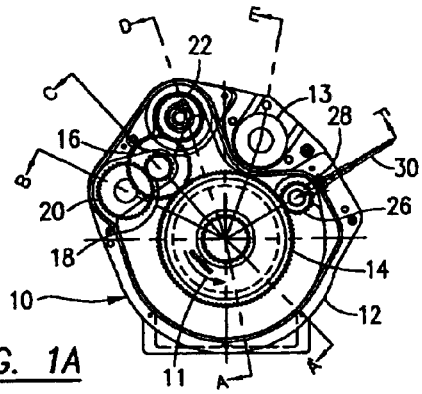
FIG. 1A diagrammatically or schematically illustrates an aft end view of the accessory drive unit.

FIG. 1A diagrammatically or schematically illustrates an aft end view of the accessory drive unit 10. Similar numerals designate similar items throughout all the figures. Accessory drive unit 10 includes a housing 12 that is mounted intermediate to the engine at the fore end side (see FIG. 1D) and to a transmission mounted at the aft end side (see FIG. 1D). A main or planetary gear 14 is mounted to the engine shaft or an extension thereof (such as a spline shaft auxiliary to the engine shaft). Main gear 14 is rotatably mounted in housing 12 of accessory drive unit 10. Gear 14 rotates in direction 11 as does the engine shaft. Pilot gear 16 is interlinked with main gear 14. A smaller pilot gear 18 is mounted coaxially with respect to the larger, first pilot gear 16. Small, second pilot gear 18 rotates with first pilot gear 16. A water pump gear 20 is interlinked with small pilot gear 18.

Figure 1C:
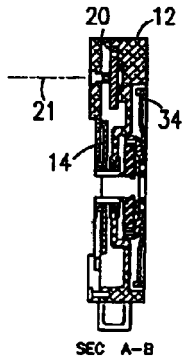
FIG. 1C diagrammatically illustrates a partial cross-sectional view of the accessory drive unit through the water pump drive gear from the perspective of section line A-B of FIG. 1A.

FIG. 1C shows water pump axial centerline 21 which is coaxial to water pump gear 20. FIG. 1C diagrammatically illustrates a partial cross-sectional view of the accessory drive unit through the water pump drive gear 20 from the perspective of section line A-B of FIG. 1A.

Returning to FIG. 1A, alternator gear 22 is interlinked with pilot gear 16. Alternator gear 22 drives alternator 15.

Figure 1B:
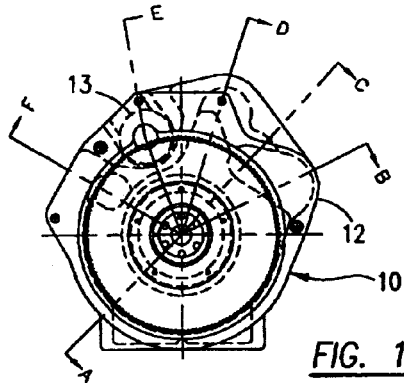
FIG. 1B diagrammatically or schematically illustrates a fore end view of the accessory drive unit.
Figure 1D:
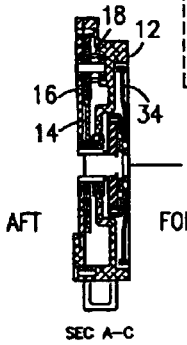
FIG. 1D diagrammatically illustrates a partial cross-sectional view of the accessory drive unit through the pilot gear from the perspective of section line A-C of FIG. 1A.

FIG. 1D diagrammatically illustrates a partial cross-sectional view of the accessory drive unit through the pilot gear 16 from the perspective of section line A-C of FIG. 1A.

Figure 1E:
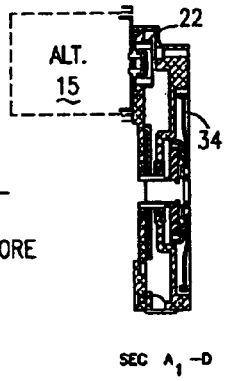
FIG. 1E diagrammatically illustrates a partial cross-sectional view of the accessory drive unit through the alternator drive gear from the perspective of section line A-D of FIG. 1A.

FIG. 1E diagrammatically illustrates a partial cross-sectional view of the accessory drive unit through the alternator drive gear 22 from the perspective of section line A-D of FIG. 1A.

Returning to FIG. 1A, starter 13 is mounted to the housing 12. The fly wheel 34 (see FIG. 1C) has a peripheral gear edge which peripheral gear is interlinked with a starter gear 44.

Figure 1F:
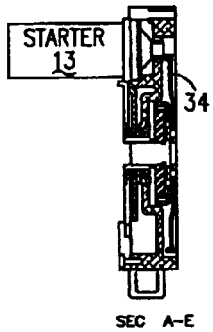
FIG. 1F diagrammatically illustrates a partial cross-sectional view of the accessory drive unit through the fly wheel peripheral gear (coupled to the starter drive gear) from the perspective of section line A-E of FIG. 1A.

FIG. 1F diagrammatically illustrates a partial cross-sectional view of the accessory drive unit through the fly wheel peripheral gear 42 on fly wheel 34, the gear 42 coupled to the starter drive gear 44, from the perspective of section line A-E of FIG. 1A.

Returning to FIG. 1A, a supplemental gear 26 is interlinked to main planetary gear 14. Supplemental gear 26 is interlinked, via a drive system, to a bevel gear 28. Bevel gear 28 is mounted to a supercharger drive shaft 30. Drive shaft 30 is rotatably mounted in housing 12.

Figure 1G:
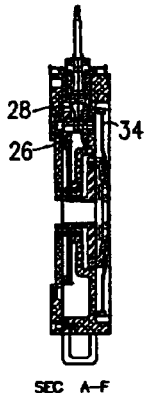
FIG. 1G diagrammatically illustrates a partial cross-sectional view of the accessory drive unit through the supercharger drive gear system from the perspective of section line A-F of FIG. 1A.

FIG. 1G diagrammatically illustrates a partial cross-sectional view of the accessory drive unit through the supercharger drive gear system 26,28 from the perspective of section line A-F of FIG. 1A.

FIG. 1B diagrammatically or schematically illustrates a fore end view of the accessory drive unit 10.

Figure 4:
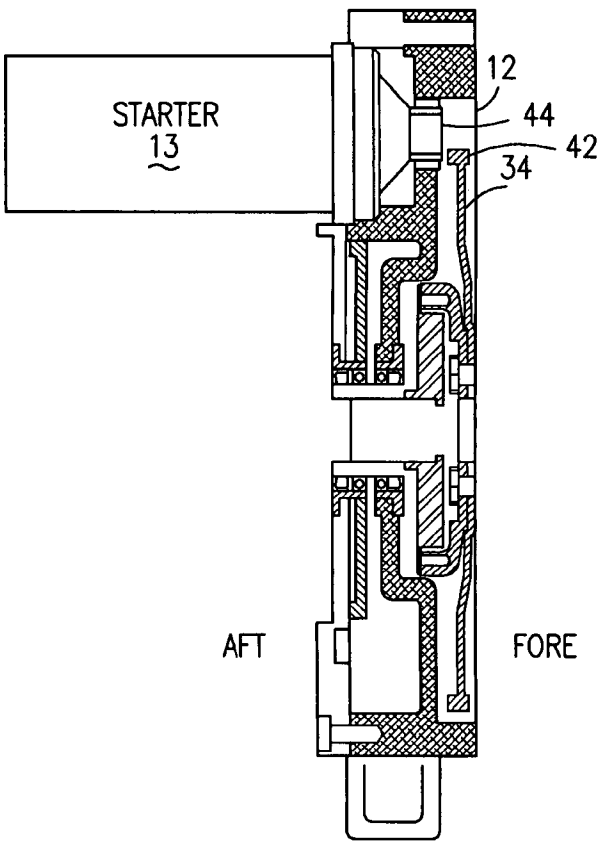
FIG. 4 diagrammatically illustrates an enlarged view of FIG. 1F (the starter gear cross-section)
Figure 3:
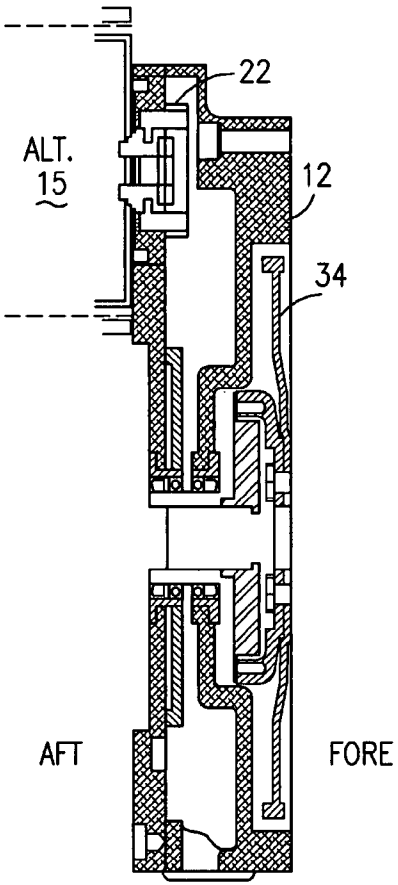
FIG. 3 diagrammatically illustrates an enlarged view of FIG. 1E (the alternator gear cross-section)
Figure 2:
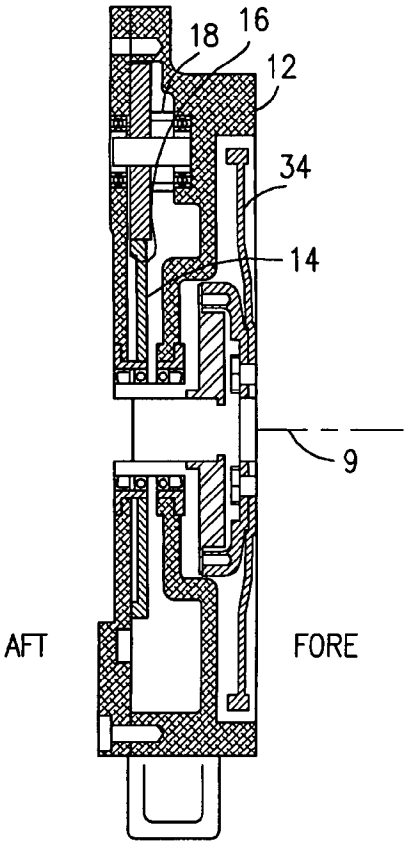
FIG. 2 diagrammatically illustrates an enlarged view of FIG. 1D (the pilot gear cross-section)

FIGS. 2, 3 and 4 diagrammatically illustrate an enlarged views of FIGS. 1D, 1E and 1F, respectively. FIG. 1 shows the pilot gear 16 cross-section and the engine or supplemental drive shaft centerline 9.

FIG. 3 diagrammatically illustrates an enlarged view of the alternator gear 22 cross-section.

FIG. 4 diagrammatically illustrates an enlarged view of the starter gear 44, peripheral gear 42 and fly wheel 34.

Figure 5:
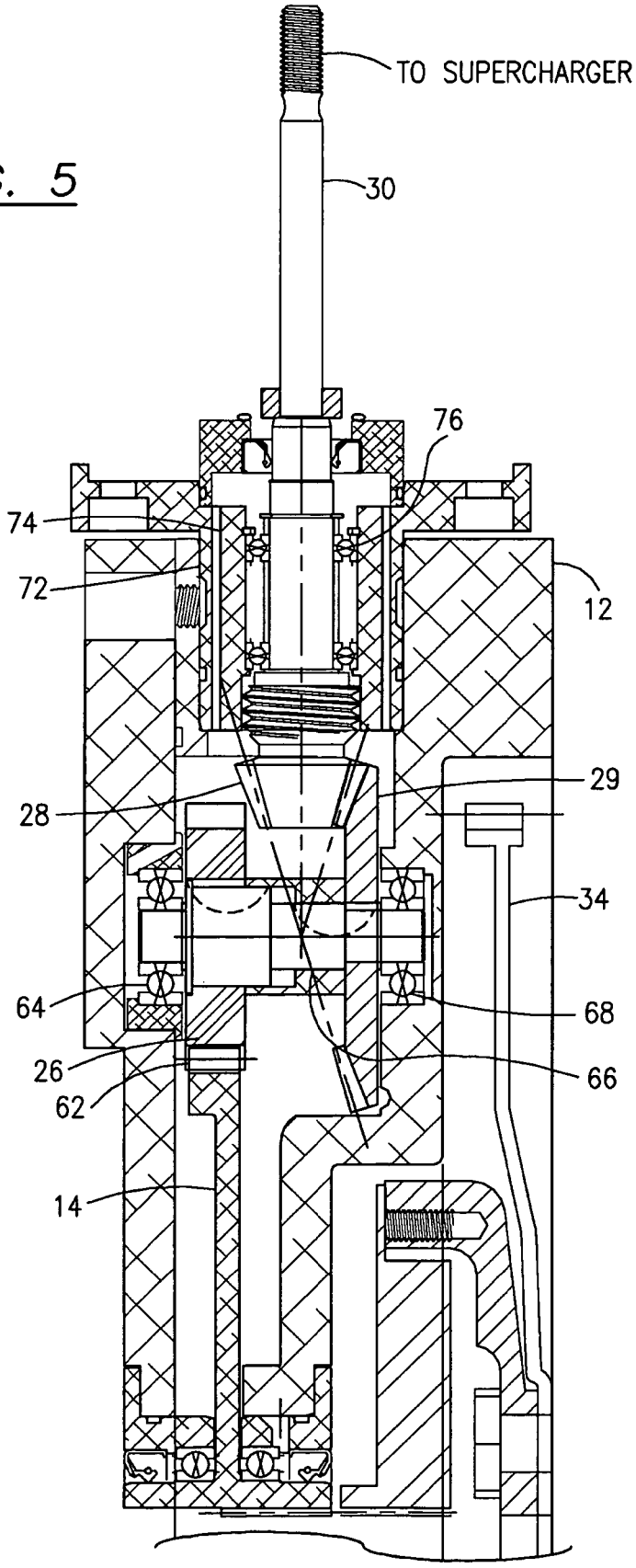
FIG. 5 diagrammatically illustrates an enlarged view of the supercharger drive cross-section.
Figure 6:
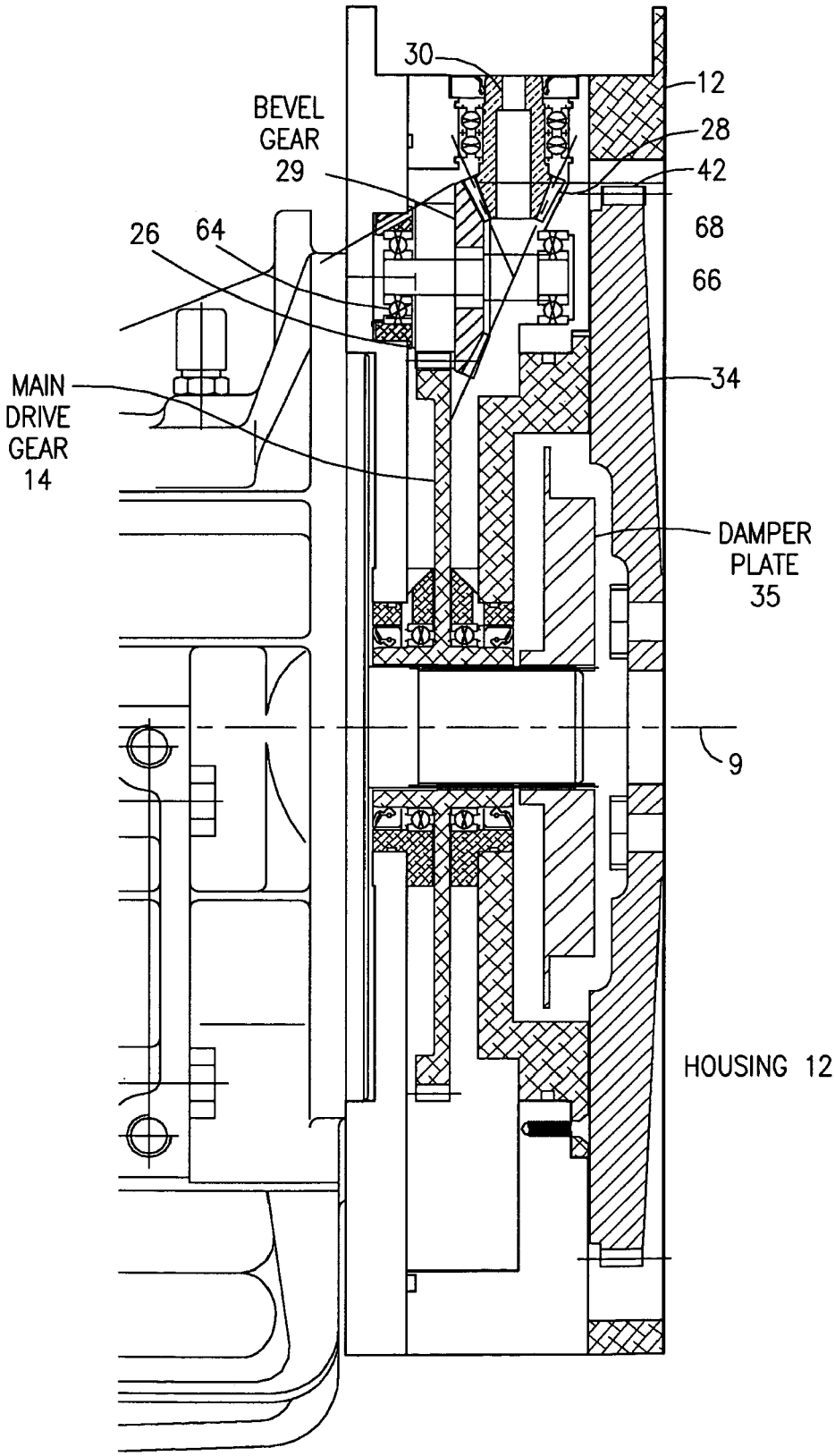
FIG. 6 diagrammatically illustrates an enlarged view of an alternative accessory drive unit-supercharger drive system.

FIG. 5 shows one embodiment of the supercharger drive sub-system and FIG. 6 shows a second embodiment. FIG. 5 illustrates that main gear 14 is interlinked to a supplemental gear 26. Gear 26 is mounted to a supplemental shaft 68. Shaft 68 rotates within housing 12 under the support of bearing sets 64, 68. Drive power from gear 26 is carried via shaft 66 to supplemental, secondary gear 29. Gear 29 is interlinked with bevel gear 28.

The supercharger drive sub-system can be removed from housing 12 by removing or withdrawing set screw 70. The supercharger drive cylinder includes generally cylindrical housing 72 and 74 which interacts and locks onto housing 12 via set screw 72. Bevel gear 28 is rotatably mounted in sub-housing 74 via bearing set 76. The bevel drive is attached to supercharger shaft 30 and the bevel gear and its supportive sub-housing can be withdrawn from the housing 12 by removal-withdrawal of set screw 70.

FIG. 6 diagrammatically illustrates an enlarged view of an alternative accessory drive unit-supercharger drive system wherein the supplemental bevel gear 29 is shifted aft and is mounted adjacent supplemental gear 26. Gear 26 is driven by main gear 14. Shaft 66 is employed to balance the rotational load on supplemental bevel gear 29. Gear 29 coacts and is interlinked with bevel gear 28 to drive the supercharger shaft 30.

Figure 7:
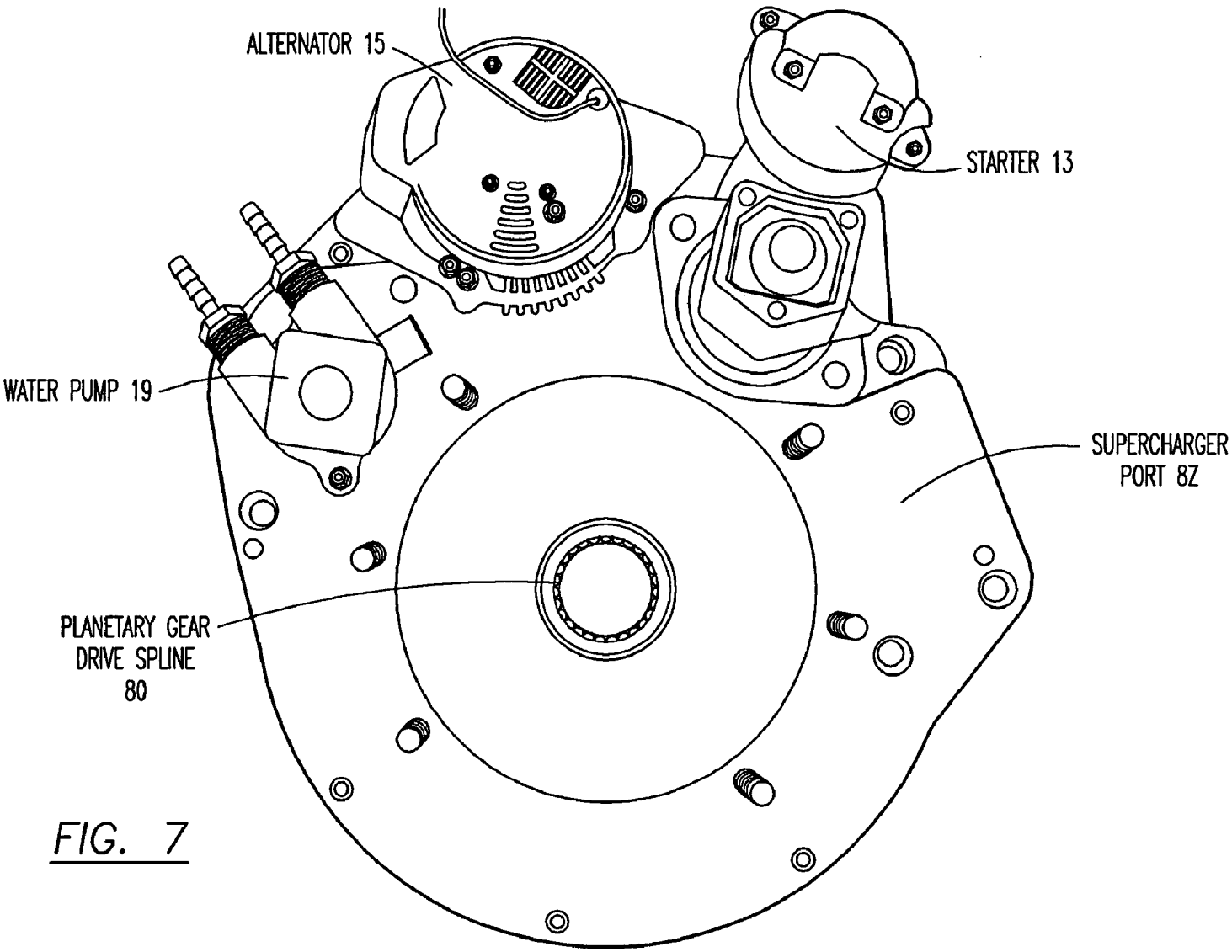
FIG. 7 diagrammatically illustrates an aft view of the accessory drive unit with the water pump, alternator, starter and supercharger port shown on the accessory drive unit housing.
Figure 8:
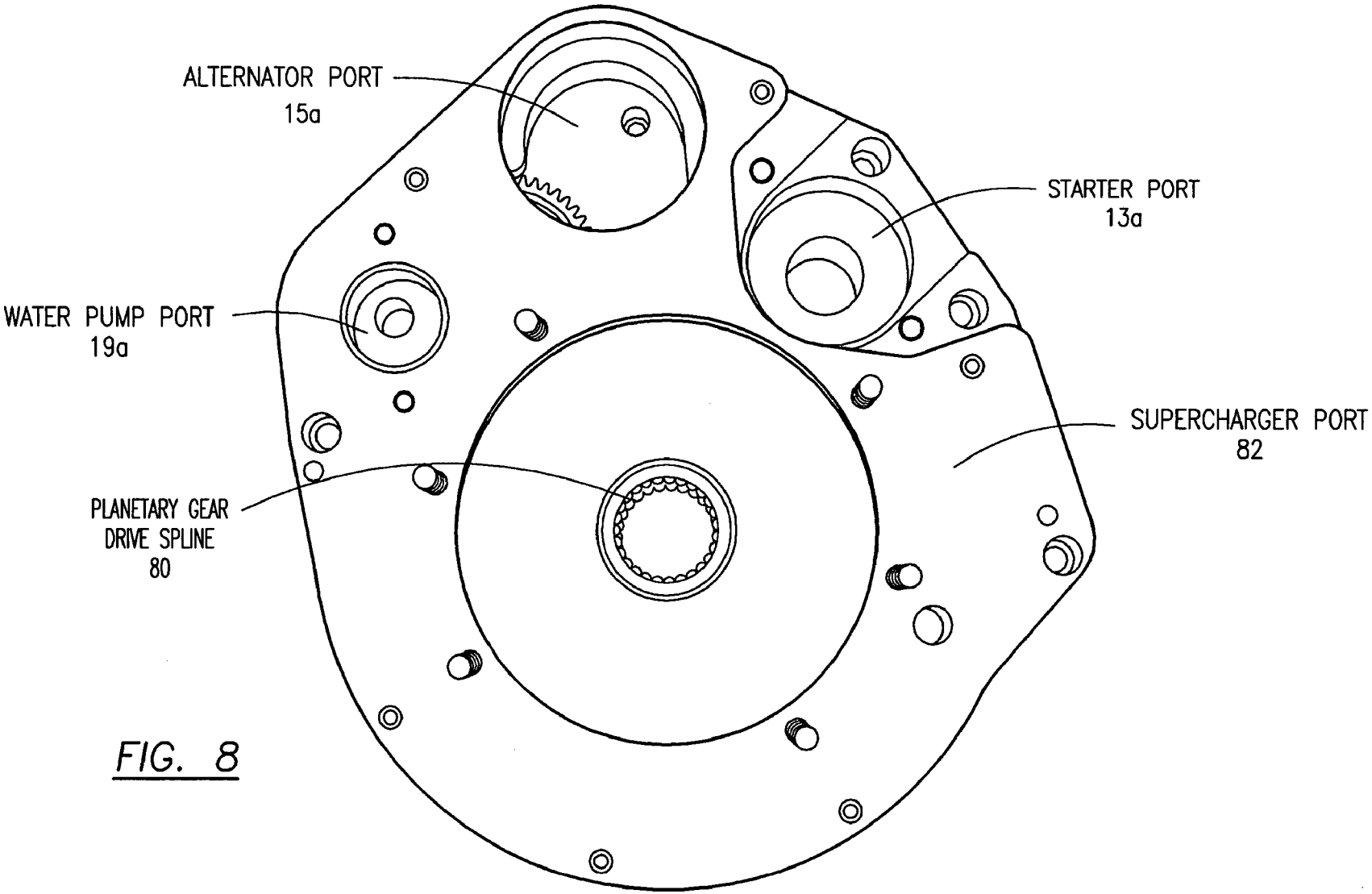
FIG. 8 diagrammatically illustrates an aft view of the accessory drive unit without the accessories; and, FIG. 9 diagrammatically illustrates a fore view of the accessory drive unit; with the water pump, alternator, starter and supercharger port shown on the accessory drive unit housing.
Figure 9:
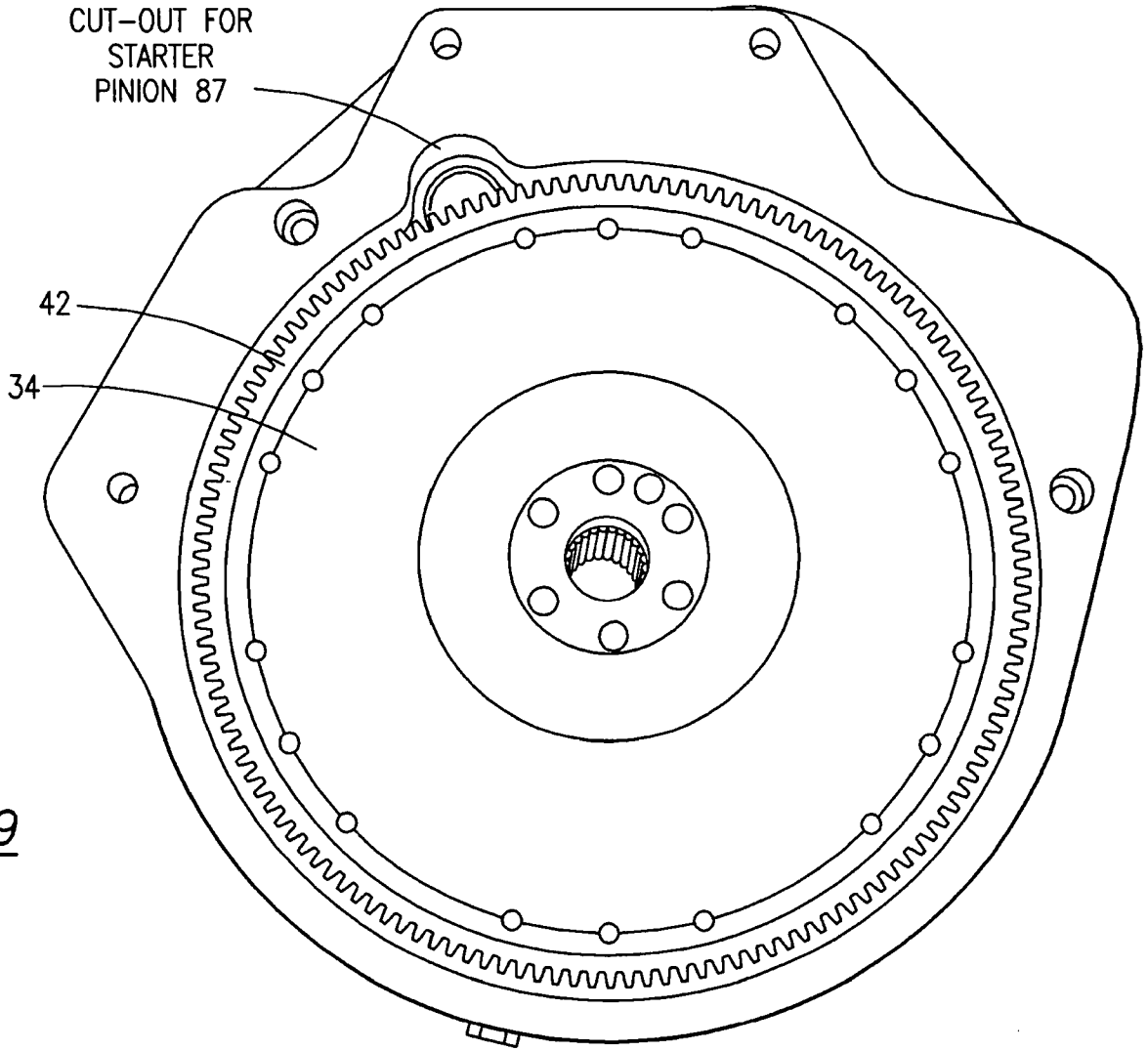

FIGS. 7, 8 and 9 diagrammatically illustrate an aft view of the accessory drive unit with the water pump, alternator, starter and supercharger port; an aft view of the accessory drive unit without the accessories; and, a fore view of the accessory drive unit, respectively. FIG. 7 illustrates accessory drive unit housing 12 with the water pump 19, alternator 15, starter 13 and supercharger port 82. Planetary gear drive spleen 80 is also shown. FIG. 8 illustrates accessory drive unit housing 12 with the water pump port 19*a*, alternator port 15*a*, pilot gear 16, starter port 13*a* and supercharger port 82. Planetary gear drive spleen 80 is also shown as is transmission or drive plate mounting studs 84.

FIG. 9 shows a fore view of the accessory drive unit with fly wheel 34 and peripheral gear 42. A cut-out for a starter pinion 87 is shown in housing 12.

The claims appended hereto are meant to cover modifications and changes within the scope and spirit of the present invention.

What is claimed is:

1. An accessory drive unit mounted intermediate an engine and a transmission for a marine vessel, automobile or motorcycle, said accessory drive unit adapted to retain and mount a water pump, an alternator, a supercharger and a starter thereon comprising:

a main planetary gear mounted to an engine drive shaft;

a first supplemental gear rotatably interconnected to said main gear, said first supplemental gear coupled via a bevel gear to a supercharger shaft, which supercharger shaft being adapted to drive said supercharger;

a first pilot gear rotatably coupled to said main gear, a second pilot gear being coaxially mounted to said first pilot gear;

a water pump gear rotatably coupled to said second pilot gear, said water pump gear adapted to drive said water pump;

an alternator gear rotatably coupled to said first pilot gear and adapted to drive said alternator;

a flywheel mounted on or about said engine drive shaft, said fly wheel having a peripheral gear thereon; and a mount for said starter, said starter having a geared drive shaft, the starter mount adapted to be attached to said started and to rotatably interlink said starter geared drive shaft with said peripheral gear on said flywheel.

2. An accessory drive unit as claimed in claim 1 including a supplemental gear shaft mounted to said first supplemental gear, a beveled drive gear mounted to both said supplemental gear shaft and said bevel gear which drives said supercharger shaft.

3. An accessory drive unit as claimed in claim 1 including a housing within which is rotatably mounted said main planetary gear, said first supplemental gear, said bevel gear, said supercharger shaft, said first pilot gear, said second pilot gear; said water pump gear, said alternator gear and said flywheel.

4. An accessory drive unit as claimed in claim 3 wherein said housing has a fore side mounted to said engine and an aft side mounted to said transmission.

5. An accessory drive unit as claimed in claim 4 wherein said flywheel is rotatably mounted to said fore side of said housing.

* * * * *